United States Patent [19]

Alpert

[11] Patent Number: 4,964,181

[45] Date of Patent: Oct. 23, 1990

[54] COMBINED SHOWER HEAD AND WATERPROOF TAPE DECK

[75] Inventor: Mayer Alpert, Sheboygan, Wis.

[73] Assignee: M. A. Industries Ltd., Sheboygan, Wis.

[21] Appl. No.: 200,229

[22] Filed: May 31, 1988

[51] Int. Cl.[5] ..... A47K 3/22

[52] U.S. Cl. ..... 4/597; 4/605; 4/601; 4/661; 128/366; 128/66

[58] Field of Search ..... 4/661, 597, 605, 615, 4/559, 567, 601; 128/366, 66

[56] References Cited

U.S. PATENT DOCUMENTS

| | | | |
|---|---|---|---|
| D. 263,584 | 3/1982 | Custagna et al. | D14/10 |
| 1,354,838 | 10/1920 | Perkins | 4/191 |
| 4,055,301 | 10/1977 | Hruby, Jr. | 239/101 |
| 4,503,563 | 3/1985 | Johnson | 374/208 |
| 4,521,919 | 6/1985 | Molloy | 455/344 |
| 4,575,882 | 3/1986 | Diamond | 4/559 |
| 4,640,462 | 2/1987 | Stearns, III | 239/383 |
| 4,649,453 | 3/1987 | Iwasawa | 360/137 |
| 4,774,934 | 10/1988 | Hara | 4/544 |

*Primary Examiner*—Henery J. Recla
*Assistant Examiner*—Edward C. Donovan
*Attorney, Agent, or Firm*—Wheeler Law Firm

[57] ABSTRACT

The combination of a shower head attachment having spaced pulsating shower heads to deliver water in pulses at spaced locations of the user's body. A waterproof radio tape player containing a pre-recorded tape of instructions for use in hydrotherapy or for personal use, and a water supply having means for varying the water force and temperature.

4 Claims, 1 Drawing Sheet

COMBINED SHOWER HEAD AND WATERPROOF TAPE DECK

BACKGROUND OF THE INVENTION

The present invention relates to the field of bathing and specifically to hydrotherapy. Since ancient times, baths have been used to reduce the effects of muscle pain, tension and nervousness. The present invention uses modern technology to update and improve upon this ancient practice. Although many references to massage shower heads or waterproof radios and tape decks are known, see for example U.S. Pat. No. Des. 263,584 (Castagna et al.), U.S. Pat. Nos. 4,055,301 (Hruby, Jr.), 4,521,919 (Molloy), 4,575,882 (Diamond), 4,640,462 (Stearns, III) and 4,649,453 (Iwasawa), none are known to the inventor which combine a pulsating shower head with a waterproof radio or tape player to perform predetermined lengths of water massage on particular body parts at pre-determined temperatures for pre-determined times. The unit may also be used for ordinary showers.

SUMMARY OF THE INVENTION

The present invention is a unit to be used in a shower area having variable hot water and cold water supplies, comprising the combination of a waterproof radio tape player and two shower heads capable of variable pulsating water delivery, whereby the force of the pulsating or steady water may, at predetermined temperatures, be aimed at different parts of the user's body for periods determined by a program of music or taped physical therapy instructions. Ideally, the water supply connected to the shower unit will contain sufficient pressure to deliver a steady flow of water and be capable of varying the temperature of that water.

Specifically the invention comprises a shower head located at or above the top of the user's head and a second shower head located at or about the user's abdomen level. The shower unit may be used in either a standing or sitting position and the shower heads are capable of being used separately or in conjunction with one another. Furthermore, the shower heads may be aimed to deliver water at different portions of the user's body. The tape player which may include added audio equipment is located in the space between the upper and lower shower heads and is powered by means of batteries. The sound equipment preferably includes instructions for a program of massage, including specified water temperature settings, aim of the shower heads to specific body parts and a specified tempo of shower pulsation. In some cases, exercises may be included.

These and other benefits of the present invention will become apparent from the following detailed description thereof taken in conjunction with the accompanying drawings.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
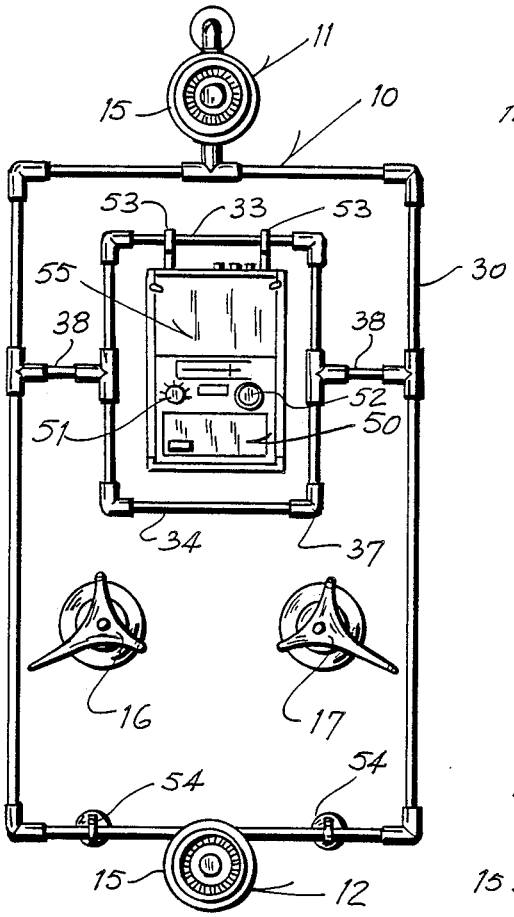
FIG. 1 is a front elevational view of the combined shower head and waterproof radio tape player.

FIG. 1 is a front elevational view of the shower unit 10. The shower unit 10 is comprised of two shower heads 11 and 12, connecting pipes 30, a water supply attachment pipe 32, a hot water pipe 35, a cold water pipe 36, hot water flow control 16, cold water flow control 17, water supply control pipe 31 and a radio/-cassette player 50. Shower head 11 is located at the top of the shower unit 10 directly above the radio/cassette player 50. Shower head 12 is located at the bottom of the shower unit 10 and directly below the radio cassette player 50. Each shower head has a control ring 15 that may be adjusted to provide a steady spray, a pulsed stream of water or a combination of a steady spray with a pulsed stream to the user. The two shower heads 11 and 12, are connected by means of pipes 30. Said connecting pipes 30 form a rectangular structure. Suspended within this rectangular structure between the lower shower head 12 and the upper shower head 11 by means of inner connecting pipes 38 is a smaller rectangular pipe structure 37 which suspends the AM/FM radio/ cassette player 50 between the upper shower head 11 and the lower shower head 12. The radio/cassette player 50 is suspended by means of hooks 53 which snap over the horizontal cross bar 33 which is part of the upper end of the rectangular pipe structure 37.

The radio cassette player 50 is waterproof and comprises a volume control switch 51, a tuning switch 52 and a slot or compartment 55 for playing cassette tapes and is powered by batteries (not shown).

Figure 2:
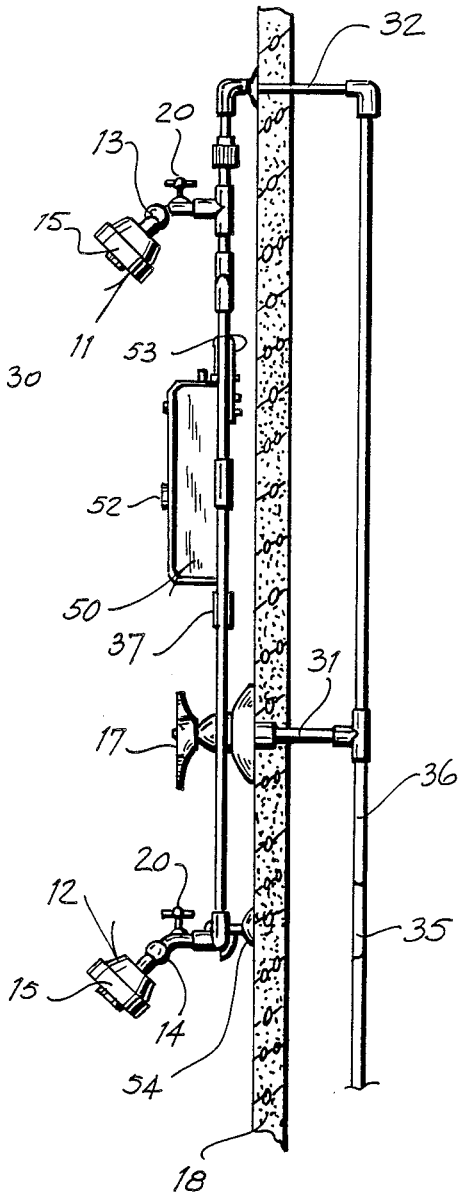
FIG. 2 is a side elevational view of the combined shower head and waterproof tape player showing the plumbing connections.

FIG. 2 is a side elevational view of the shower unit 10 showing the relationship of the shower unit 10 to the shower wall 18 and the water supply. The shower unit 10 is connected by means of pipe 32 to the water supply. Pipes 35 and 36 represent the hot and cold water pipes respectively. Pipe 34 connects cold water control 17 and hot water control 16 for controlling the flow of the hot and cold water to pipes 35 and 36. FIG. 2 also shows shower head closure valves 20; whereby the flow of water to either shower head may be regulated independent of water controls 16 and 17. FIG. 2 also shows ball joints 13 and 14 which are respectively part of shower head 11 and shower head 12. The ball joints 13 and 14 allow shower heads 11 and 12 to be aimed at any portion of the user's body that the user so desires or the taped massage program indicates. The water controls 16 and 17 allow the force and temperature to follow the massage program and pulsations are adjusted to the program also.

The foregoing is considered as illustrative only of the principles of the invention. Furthermore, since numerous modifications and changes will readily occur to those skilled in the art, it is not desired to limit the invention to the exact construction and operation shown and described, except as claimed.

What is claimed is:

1. A shower unit comprising;

at least one adjustable shower head and waterproof means located in said shower unit for reproducing prerecorded audible instructions for different types of hydrotherapy for personal usage;

water supply means comprising variable volume hot water and variable volume cold water supply means, said showerhead being connected to receive said water from said water supply means, at least one said shower head being adjustable to deliver a pulsed spray of water to selected locations of the user's body, while said means for reproducing audible instructions located in said shower unit is operating.

2. The device of claim 1 in which the waterproof means for reproducing audible instructions is a cassette player;

whereby a tape may be played on the cassette player and the shower unit user is given instructions as to different forms of hydrotherapy.

3. The device of claim 1 in which the water supply means are hot and cold water pipes attached to a water supply, said water supply having a source of cold water and a source for hot water, said water supply also having sufficient pressure to supply said water in sufficient volume to the adjustable shower heads of the shower unit.

4. The device of claim 1 in which the shower unit comprises;

an upper adjustable pulsating shower head;

a lower adjustable pulsating shower head;

pipes connecting said shower heads to a water supply;

said water supply having means for varying the water force and temperature;

control means for adjusting the flow of water to the shower heads;

a cassette player;

whereby the shower unit may be used for hydrotherapy and instructions may be given to the user over the cassette player and the force and direction of the pulsed spray of water from the shower heads may be directed as the user desires.

* * * * *